US005785812A

United States Patent [19]

Linsten et al.

[11] Patent Number: 5,785,812

[45] Date of Patent: Jul. 28, 1998

[54] PROCESS FOR TREATING OXYGEN DELIGNIFIED PULP USING AN ORGANIC PERACID OR SALT, COMPLEXING AGENT AND PEROXIDE BLEACH SEQUENCE

[75] Inventors: Magnus Linsten, Kungälv; Jiri Basta, Partille; Ann-Sofie Hällström, Göteborg, all of Sweden

[73] Assignee: Eka Nobel AB, Sweden

[21] Appl. No.: 436,243

[22] PCT Filed: Nov. 25, 1993

[86] PCT No.: PCT/SE93/01019

§ 371 Date: May 17, 1995

§ 102(e) Date: May 17, 1995

[87] PCT Pub. No.: WO94/12721

PCT Pub. Date: Jun. 9, 1994

[30] Foreign Application Priority Data

Nov. 27, 1992 [SE] Sweden ..... 9203585
Jan. 26, 1993 [SE] Sweden ..... 9300226

[51] Int. Cl.[6] ..... D21C 9/16

[52] U.S. Cl. ..... 162/76; 162/65; 162/78

[58] Field of Search ..... 162/76, 78, 65, 162/83, 84

[56] References Cited

FOREIGN PATENT DOCUMENTS

25382/92 4/1993 Australia .
402 335 12/1990 European Pat. Off. .
415 149 3/1991 European Pat. Off. .
480 469 4/1992 European Pat. Off. .
57-21591 2/1982 Japan .
WO 92/15752 9/1992 WIPO .

*Primary Examiner*—Steven Alvo
*Attorney, Agent, or Firm*—Ralph Mancini; Louis Morris

[57] ABSTRACT

A process for delignifying and bleaching lignocellulose-containing pulp, in which the pulp is delignified with a peracid or a salt thereof, treated with a complexing agent, and subsequently bleached with a chlorine-free bleaching agent. Suitably delignification is carried out with the strongly oxidizing peracetic acid, giving a considerable increase in brightness and a considerable reduction of the kappa number after bleaching with a chlorine-free bleaching agent comprising at least one of a peroxide-containing compound, ozone or sodium dithionite, or optional sequences or mixtures thereof. The brightness increasing effect is highly selective, i.e. the viscosity of the pulp is maintained to a comparatively great extent. Both the delignification and the treatment with a complexing agent are advantageously carried out at a close to neutral pH, thus minimizing the need of pH adjustment and making it possible to use spent bleach liquor internally, e.g. for washing the pulp. By final bleaching with ozone and hydrogen peroxide it is possible to produce softwood pulps having a brightness exceeding 90% ISO, and to remove practically all lignin in the pulp while maintaining sufficient pulp strength.

10 Claims, No Drawings

PROCESS FOR TREATING OXYGEN DELIGNIFIED PULP USING AN ORGANIC PERACID OR SALT, COMPLEXING AGENT AND PEROXIDE BLEACH SEQUENCE

The present invention relates to a process for delignifying and bleaching lignocellulose-containing pulp, in which the pulp is delignified with a peracid or a salt thereof, treated with a complexing agent, and subsequently bleached with a chlorine-free bleaching agent. Suitably, delignification is carried out with the strongly oxidising peracetic acid, giving a considerable increase in brightness and a considerable reduction of the kappa number after bleaching with a chlorine-free bleaching agent comprising at least one of a peroxide-containing compound, ozone or sodium dithionite, or optionally sequences or mixtures thereof. The brightness-increasing effect is highly selective, i.e. the viscosity of the pulp is maintained to a comparatively great extent.

BACKGROUND OF THE INVENTION

Chlorine-free bleaching agents have long been used for bleaching mechanical pulps. In recent years, it have come increasingly common to bleach also chemical pulps with chlorine-free bleaching agents, such as hydrogen peroxide and ozone, even in the first stages. It has been considered necessary to pretreat the pulp directly after digestion and an optional oxygen-delignifying stage so as to avoid deteriorated pulp properties and an excessive consumption of the bleaching agent. Pretreatment of the pulp primarily involves acid treatment and treatment with a complexing agent or salts of alkaline-earth metals, optionally in combination. Strongly acid pretreatment removes desirable as well as undesirable metal ions from the original positions in the pulp. Treatment with suitable complexing agents primarily removes the undesirable metal ions, while the desirable ones are largely retained. Treatment with salts of alkaline-earth meals maintains or reintroduces the desirable metal ions.

EP-A-0 402 335 thus discloses the pretreatment of chemical pulp with a complexing agent directly after digestion or oxygen delignification, to make a subsequent alkaline peroxide bleaching more efficient.

EP-A-0 480 469 relates to delignification of lignocellulose-containing pulp with oxygen. The pulp can be delignified or bleached before or after the oxygen state with peroxide-containing compounds, such as hydrogen peroxide or peracetic acid, chlorine dioxide and/or ozone. Use of sequences with both peracetic acid and hydrogen peroxide, results in a significant decrease in pulp viscosity.

U.S. Pat. No. 5,091,054 describes a process where a pulp is treated with a sequence in two steps. In the first step peroxomonosulphuric acid, i.e. Caro's acid (=an inorganic acid containing sulphur), is added. A complexing agent may be added in the treatment with Caro's acid. In the second step of the pulp is bleached with peroxide and/or oxygen.

With increasingly stringent environmental standards, there is a growing need for completely chlorine-free processes for delignifying and bleaching lignocellulose-containing pulps. To produce fully bleached pulps with unaltered strength properties in a reasonable number of stages and with a reasonable consumption of bleaching agents, it has become necessary to consider using also powerful, and hence difficulty-controlled, bleaching agents having a high delignifying and/or bleaching capacity.

DESCRIPTION OF THE INVENTION

The invention provides a process in which lignocellulose-containing pulp is delignified and bleaching under the conditions disclosed in the appended claims, whereby a good delignifying and bleaching effect is obtained even before the chlorine-free bleaching.

The inventive process comprises delignifying and bleaching lignocellulose-containing pulp, wherein the pulp is delignified with a peracid or salts thereof, whereupon the pulp is treated with a complexing agent and subsequently bleached with a chlorine-free bleaching agent comprising at least one of a peroxide-containing compound, ozone or sodium dithionite, or optional sequences or mixtures thereof.

The invention process has made it possible to delignify the pulp before a chlorine-free bleaching, such that the subsequent treatment with a complexing agent can be used for optimising the conditions for the subsequent chlorine-free bleaching, taking into consideration the desirable and undesirable metal ions. Thus, ions of alkaline-earth metals, especially when in their original positions in the pulp, are known to have a favourable effect on the selectivity in bleaching and the consumption of chlorine-free bleaching agents, such as peroxide-containing compounds and ozone.

In the invention, peracid or salts thereof include organic peracids or salts thereof. As organic peracid, use is made of aliphatic peracids, aromatic peracids or salts thereof. Suitably, peracetic acid or performic acid is used. Sodium is suitably used as cation in the salts, since such salts normally are inexpensive and sodium occurs naturally in the chemical balance in the pulp mill. Preferably, peracetic acid, or a salt thereof is used. Peracetic acid is especially preferred, being advantageous in terms of production and use. In addition, peracetic acid has limited corrosiveness. Any wastewater containing, inter alia, the degradation products of peracetic acid can be easily recycled to the chemical recovery system.

According to the invention process, peracetic acid can be produced to reacting acetic acid and hydrogen peroxide, giving what is known as equilibrium peracetic acid, by distilling equilibrium peracetic acid to remove hydrogen peroxide, acetic acid and sulphuric acid, or by reacting acetic acid anhydride and hydrogen peroxide directly in the bleaching stage, giving what is known as in situ peracetic acid. A typical equilibrium peracetic acid contains about 42% of peracetic acid and about 6% of hydrogen peroxide, i.e. the weight ratio of peracetic acid to hydrogen peroxide is here about 7:1. Equilibrium peracetic acid is advantageously used in the present process. In the present process, the weight ratio between peracetic acid and hydrogen peroxide can be in the range of from about 10:1 to about 1:60, suitably from 7:1 to 1:15 and preferably from 2.8:1 to 1:2.

The added amount of peracid or salts thereof should be in the range of from about 1 kg up to about 100 kg per tonne of dry pulp, calculated as 100% peracid or salt thereof. Suitably, this amount lies in the range of from 2 kg up to 45 kg per tonne of dry pulp, and preferably in the range of from 3 kg up to 25 kg per tonne of dry pulp, calculated at 100% peracid or salt thereof.

Suitably, delignification with peracid or salts thereof is carried out at a pH in the range of from about 2.5 up to about 12. In preferred embodiments, where delignification is carried out with peracetic acid or peroxomonosulphuric acid, the pH lies suitably in the range of from 3 up to 10, and preferably in the range of from 5 up to 7.5. Delignification with the other peracids or salts thereof mentioned above takes place within the normal pH ranges for the respective bleaching agents, these being well-known to those skilled in the art.

In the pulp, manganese ions, inter alia, have a particularly adverse effect on the bleaching with chlorine-free bleaching agents, such as ozone and alkaline peroxide compounds. Thus, compounds forming strong complexes with various manganese ions are primarily used as complexing agents. Such suitable complexing agents are nitrogenous organic compounds, primarily nitrogenous polycarboxylic acids, nitrogenous polyphosphonic acids and nitrogenous polyalcohols. Preferred nitrogenous polycarboxylic acids are diethylenetriaminepentaacetic acid (DTPA), ethylenediaminetetraacetic acid (EDTA) or nitrilotriacetic acid (NTA), DTPA and EDTA being especially preferred. Diethylenetriaminepentaphosphonic acid is the preferred nitrogenous polyphosphonic acid. Also other compounds can be used as complexing agents, such as polycarboxylic acids, suitably oxalic acid, citric acid or tartaric acid, or phosphonic acids. Other usable complexing agents are such organic acids as are formed during the pulp treatment with, inter alia, chlorine-free bleaching agents.

The pH in the treatment with a complexing agent is of decisive importance in removing the undesirable trace metal ions while at the same time retaining the desirable ions of alkaline-earth metals. A suitable pH range depends, inter alia, on the type and the amount of trace metal ions in the incoming pulp. In the inventive process, the treatment with a complexing agent should be carried out at a pH in the range of from about 2.5 up to about 11, suitably in the range of from 3.5 up to 10, and preferably from 4.5 up to 9.

The selection of temperature in the treatment with a complexing agent is of major importance for removal of the undesirable trace metal ions. Thus, the content of manganese ions decreases with increasing temperature in the treatment with a complexing agent, which gives an increase in brightness and a reduction of the kappa number. For instance, when increasing the temperature from 20° C. to 90° C., there is also, surprisingly, a noticeable increase in viscosity. The treatment with a complexing agent should be carried out at a temperature of from 26° C. up to about 120° C. suitably from 26° C. up to about 100° C., preferably from 40° C. up to 95° C., and most preferably from 55° C. up to 90° C.

The added amount of complexing agent depends on the type and the amount of trace metal ions in the incoming pulp. This amount is also affected by the type of complexing agent as well as the conditions in the treatment with a complexing agent, such as temperature, residence time and pH. The added amount of complexing agent should, however, be in the range of from about 0.1 kg up to about 10 kg per tonne of dry pulp, calculated as 100% complexing agent. Suitably, the amount lies in the range of from 0.3 kg up to 5 kg per tonne of dry pulp, and preferably in the range of from 0.5 kg up to 1.8 kg per tonne of dry pulp, calculated as 100% complexing agent.

In preferred embodiments, where both the delignification with peracid and the treatment with a complexing agent are carried out at a close to neutral pH, the need of pH adjustment is minimised. As a result, also the spent liquors from the bleaching and treatment stages can be used internally for washing. This gives a small total wastewater volume, enabling a considerably more closed system in the pulp mill.

Chlorine-free bleaching agent comprises a peroxide-containing compound or ozone in an optional sequence or mixture. Sodium dithionite can also be used as chlorine-free bleaching agent. The peroxide-containing compound suitably consists of inorganic peroxide compounds, such as hydrogen peroxide or peroxomonosulphuric acid (Caro's acid). Preferably, the peroxide-containing compound is hydrogen peroxide or a mixture of hydrogen peroxide and oxygen.

Using hydrogen peroxide as chlorine-free bleaching agent, the pulp can be treated at a pH of from about 7 up to about 13, suitably at a pH of from 8 up to 12, and preferably at a pH of from 9.5 up to 11.5. Bleaching with the other chlorine-free bleaching agents mentioned above takes place within the normal pH ranges for the respective bleaching agents, these being well-known to those skilled in the art.

The process according to the invention is suitably carried out with a washing stage after the treatment with a complexing agent. Washing efficiently removes the complexed trace metal ions that have an adverse effect on the following chlorine-free bleaching, primarily manganese ions but also ions of e.g. copper and iron. To retain in the pulp the alkaline-earth metal ions that are advantageous to the following chlorine-free bleaching, primarily magnesium and calcium ions, the pH should be at least about 4 in the washing stage. Suitably, the pH in the washing stage lies in the range of from 5 up to about 11, preferably in the range of from 6 up to 10.

The washing liquid may be fresh water, optionally with an addition of a pH-adjusting chemical, or wastewater from one or more bleaching stages or extraction stages, in such a way that a suitable pH in the washing stage is obtained. The washing liquid may also consist of other types of optionally purified wastewater, provided it has a low content of undesirable metal ions, such as manganese, iron and copper.

The term washing after the complexing agent treatment relates to methods for displacing, more or less completely, the spent liquid in the pulp suspension to reduce its content of, inter alia, dissolved trace metal ions in said suspension. The washing methods may entail an increase in the pulp concentration, for example by dilution with washing liquid. The washing methods may also entail a reduction of the pulp concentration, for example by dilution with washing liquid. Washing also means combinations and sequences where the pulp concentration is alternately increased and reduced, one or more times. In the present process, a washing method is chosen which, in addition to removing dissolved organic substance, also removes the trace metal ions released in the treatment with a complexing agent, while considering what is suitable in terms of process technique and economy.

Washing efficiency may be given as the amount of liquid phase displaced as compared with the liquid phase present in the pulp suspension before washing. The total washing efficiency is calculated as the sum of the efficiency in each washing stage. Thus, dewatering of the pulp suspension after a treatment stage from, say, 10% to 25% pulp concentration gives a washing efficiency of 66.7%. After a subsequent washing stage in which the pulp is first diluted to 3% and then dewatered to 25%, a total washing efficiency of 96.9% is achieved with respect to soluble impurities. In the present process, the washing efficiency should be at least about 75%, suitably in the range of from 90% up to 100%, and preferably in the range of from 92% up to 100%. A washing efficiency in the range of from 96% up to 100% is especially preferred.

By using the inventive process, the conditions for the chlorine-free bleaching, are optimised such that a high brightness, kappa number reduction and viscosity are achieved with a minimum consumption of chlorine-free bleaching agent. This becomes possible without using any auxiliary chemicals, such as stabilisers and protective agents, in the chlorine-free bleaching. The remaining bleaching chemicals, such as hydrogen peroxide and alkali, may advantageously be used directly in the bleaching stage, the peracid stage or any other suitable stage, such that an optimum combination of process technique and production economy is obtained.

The term lignocellulose-containing pulp refers to pulps containing fibres that have been separated by chemical or mechanical treatment, or recycled fibres. The fibres may be of hardwood or softwood. The term chemical pulp relates to pulps digested according to the sulphate, sulphite, soda or organo-solv process. The term mechanical pulp refers to pulp produced by refining chips in a disc refiner (refiner mechanical pulp) or by grinding logs in a grinder (groundwood pulp). The term lignocellulose-containing pulp also relates to pulps produced by modifications or combinations of the above-mentioned methods or processes. Examples of such pulps are thermomechanical, chemimechanical and chemi-thermomechanical pulps. Suitably, the lignocellulose-containing pulp consists of chemically digested pulp, preferably sulphate pulp. A lignocellulose-containing pulp consisting of sulphate pulp of softwood is especially preferred.

The process according to the invention can be applied to pulps with a yield of up to about 90%, suitably in the range of from 30% up to 80%, and preferably in the range of from 45% up to 65%.

The inventive process can be carried out in an optional position in the bleaching sequence, e.g. immediately after the making of the pulp. When the inventive process is applied to chemically digested pulp, this is preferably delignified in an oxygen stage before the delignification with peracid.

The inventive process can be applied to chemically digested pulps having an initial kappa number in the range of from about 2 up to about 100, suitably from 5 up to 60, and preferably from 10 up to 40. The kappa number is then measured according to the SCAN-C 1:77 Standard Method.

In the inventive process, the delignification with peracid should be carried out at a temperature in the range of from about 10° C. up to about 140° C., suitably from about 10° C. up to about 120° C., and preferably from about 10° C. up to about 100° C. More preferably the delignification with peracid is carried out at a temperature in the range of from 30° C. up to 90° C., and most preferably from 50° C. up to 80° C. Delignification with peracid should be carried out for a period of time of from about 1 min up to about 960 min, suitably from 10 min up to 270 min, and preferably from 30 min up to 150 min. The pulp concentration in the delignification with peracid may be from about 1% by weight up to about 70% by weight, suitably from 3% by weight up to 50% by weight, preferably from 8% by weight up to 35% by weight and most preferably from 10% by weight up to 30% by weight.

In the inventive process, the treatment with a complexing agent should be carried out for a period of time of from about 1 min up to about 960 min, suitably from 15 min up to 240 min, and preferably from 35 min up to 120 min. In the treatment with a complexing agent, the pulp concentration may be from abut 1% by weight up to about 60% by weight, suitably from 2.5% by weight up to 40% by weight, preferably from 3.5% by weight up to 25% by weight and most preferably from 5.5% by weight up to 25% by weight.

When using hydrogen peroxide as chlorine-free bleaching agent, the pulp should be treated at a temperature of from about 30° C. up to about 140° C., and suitably from about 30° C. up to about 120° C. Preferably the pulp is treated at a temperature of from about 30° C. up to about 100° C. and more preferably from 60° C. up to 90° C. The pulp should be treated for a period of time of from about 5 min up to about 960 min, suitably from 60 min up to 420 min, preferably from 190 min up to 360 min. When using hydrogen peroxide as chlorine-free bleaching agent, the pulp concentration may be from about 1% by weight up to about 70% by weight, suitably from 3% by weight up to 50% by weight, preferably from 8% by weight up to 35% by weight and most preferably from 10% by weight up to 30% by weight. Treatment with the other chlorine-free bleaching agents mentioned above takes place within the normal ranges as to temperature, time and pulp concentration for the respective bleaching agents, these being well-known to those skilled in the art.

In preferred embodiments using hydrogen peroxide as chlorine-free bleaching agent, the amount of hydrogen peroxide added in the bleaching stage should be in the range of from about 1 kg up to about 60 kg per tonne of dry pulp, calculated as 100% hydrogen peroxide. The upper limit is not critical, but has been set for reasons of economy. Suitably, the amount of hydrogen peroxide is in the range of from 6 kg up to 50 kg per tonne of dry pulp, and preferably from 13 kg up to 50 kg per tonne of dry pulp, calculated at 100% hydrogen peroxide.

In preferred embodiments using ozone as chlorine-free bleaching agent, the amount of ozone may be in the range of from about 0.5 kg up to about 30 kg per tonne of dry pulp, suitably in the range of from 1 kg up to 15 kg per tonne of dry pulp, preferably from 1.5 kg up to 10 kg per tonne of dry pulp and most preferably from 1.5 kg up to 5 kg per tonne of dry pulp.

After delignification with peracid, treatment with a complexing agent and subsequent chlorine-free bleaching, the pulp can be used for direct production of paper. The pulp may also be finally bleached to a desired higher brightness in one or more stages. Suitably, final bleaching is also carried out by means of such chlorine-free bleaching agents as are indicated above, optionally with intermediate extraction stages which can be reinforced by peroxide and/or oxygen. In this way, the formation and discharge of AOX is completely eliminated. It is also possible to use chlorine-containing bleaching agents, such as chlorine dioxide, in the final bleaching and yet obtain a very limited formation and discharge of AOX, since the lignin content of pulp has been considerably reduced by the present process.

The invention and its advantages will be illustrated in more detail by the Examples below which however, are only intended to illustrate the invention without limiting the same. The percentages and parts stated in the description, claims and Examples, refer to percent by weight and parts by weight, respectively, unless otherwise states. Furthermore, the pH values given in the description, claims and Examples refer to the pH at the end of each treatment, unless otherwise stated.

In the Examples below, the kappa number, viscosity and brightness of the pulp were determined according to the SCAN Standard Methods C 1:77 R, C 15–16:62 and C 11–75:R, respectively. The consumption of hydrogen peroxide and peracetic acid were established by titration with sodium thiosulphate, and potassium permanganate and sodium thiosulphate, respectively.

EXAMPLE 1

Oxygen-delignified sulphate pulp of softwood having a kappa number of 12.4, a brightness of 38.4% ISO, and a viscosity of 1100 $dm^3/kg$ was delignified with peracetic acid (PAA), treated with EDTA and bleached with hydrogen peroxide, to illustrate the effect of pH in the treatment with a complexing agent. The added amount of peracetic acid was 22.4 kg/tonne dry pulp, calculated as 100% peracetic acid. In the delignification, the temperature was 70° C., the treatment time 60 min, the pulp concentration 10% by weight, and the pH 5–5.5. After delignification, the pulp was treated with 2 kg EDTA/tonne dry pulp at varying pH, a temperature of 90° C., a residence time of 60 min, and a pulp concentration of 10% by weight. The pulp was then bleached with hydrogen peroxide at a temperature of 90° C., a residence time of 240 min, and a pulp concentration of 10% by weight. The addition of hydrogen peroxide was 25 kg/tonne dry pulp, calculated as 100% hydrogen peroxide, and the pH was 10.5–11. After each stage, the pulp was washed with deionised water at a pH of 6.0. At this, the pulp was first dewatered to 25% pulp concentration and subsequently diluted to a pulp concentration of 3% by weight. After a few minutes, the pulp was dewatered to a pulp concentration of 25% by weight. Thus, the total washing efficiency was about 97%. The results after bleaching with hydrogen peroxide appear from the Table below.

TABLE I

| pH in the | Pulp properties after the $H_2O_2$ bleaching | | |
|---|---|---|---|
| treatment with a complexing agent | Kappa number | Viscosity ($dm^3/kg$) | Brightness (% ISO) |
| 1.5 | 4.2 | 900 | 71 |
| 2.7 | 3.4 | 920 | 76 |
| 4.8 | 3.0 | 940 | 81 |
| 5.4 | 2.9 | 945 | 83 |
| 7.9 | 3.0 | 940 | 81 |
| 10.5 | 4.0 | 890 | 75 |
| 12.3 | 4.5 | 840 | 65 |

As is evident from the Table, treatment of pulp with a complexing agent according to the present invention results in a considerable increase in brightness and a considerable reduction of the kappa number reduction.

EXAMPLE 2

Oxygen-delignified sulphate pulp of hardwood having a kappa number of 12.4, a brightness of 49.8% ISO, and a viscosity of 1270 $dm^3/kg$ was delignified with peracetic acid, treated with EDTA and bleached with hydrogen peroxide, to illustrate the importance of the complexing agent, and more specifically the importance of a treatment with a complexing agent in a separate stage. The conditions in the delignification with peracetic acid and the bleaching with hydrogen peroxide were as in Example 1. The conditions in the treatment with EDTA were as in Example 1, except that the pH was 5.8 throughout. For comparison, the pulp was treated in the absence of a complexing agent at a pH of 6.0, a temperature of 90° C. and a residence time of 60 min (test 2). For further comparison, the pulp was delignified with peracetic acid in the presence of EDTA at a pH of 5.1, followed by bleaching with hydrogen peroxide (test 3). After each stage, the pulp was washed in accordance with Example 1. The results after the bleaching with hydrogen peroxide appear from the Table below.

TABLE II

| | Pulp properties after the $H_2O_2$ bleaching | | |
|---|---|---|---|
| Test | Kappa number | Viscosity ($dm^3/kg$) | Brightness (% ISO) |
| 1 | 3.8 | 1063 | 67.2 |
| 2 | 4.7 | 1013 | 77.3 |
| 3 | 6.6 | 931 | 80.6 |

It is evident from the Table that treatment of pulp according to the present invention with a complexing agent in a separate stage results in a considerable increase in brightness and a considerable reduction of the kappa number while at the same time the highest viscosity of the pulp is achieved.

EXAMPLE 3

The oxygen-delignified sulphate pulp of hardwood used in Example 2 was treated according to the present process, to illustrate the effect of the initial delignification with peracetic acid on the pulp properties. The conditions in the delignification with peracetic acid, the treatment with EDTA, as well as the bleaching with hydrogen peroxide, were as in Example 2. For comparison, the pulp was treated with EDTA and bleached with hydrogen peroxide without any preceding delignification with peracetic acid (test 2). After each stage, the pulp was washed in accordance with Example 1. The results after the bleaching with hydrogen peroxide appear from the Table below.

TABLE III

| | Pulp properties after the $H_2O_2$ bleaching | | |
|---|---|---|---|
| Test | Kappa number | Viscosity ($dm^3/kg$) | Brightness (% ISO) |
| 1 | 3.8 | 1063 | 87.2 |
| 2 | 7.5 | 1109 | 82.5 |

It is evident from the Table that delignification with peracetic acid before treatment with a complexing agent and bleaching with hydrogen peroxide yields a pulp having considerably higher brightness and lower lignin content while at the same time the difference in pulp viscosity is comparatively small.

EXAMPLE 4

The oxygen-delignified suplhate pulp of softwood used in Example 1was treated in accordance with the invention, followed by bleaching with ozone and hydrogen peroxide. The sequence used was peracetic acid—treatment with a complexing agent—hydrogen peroxide—ozone—hydrogen peroxide, i.e. PAA—Q—P—Z—P. The conditions in the delignification with peracetic acid, the treatment with EDTA, as well as the bleaching with hydrogen peroxide were as in Example 2. For comparison, the pulp was treated without delignification with peracetic acid, i.e. Q—P—Z—P (test 2). In the ozone stage, the pulp was bleached at a temperature of 25° C., a contact time of 2 min, and a pulp concentration of 37% by weight. The consumption of ozone was 2.6 kg/tonne dry pulp, and the pH was 2.1. In the second hydrogen peroxide stage, the pulp was bleached at a temperature of 70° C., a residence time of 60 min, and a pulp concentration of 10% by weight. The addition of hydrogen peroxide was 5 kg/tonne dry pulp, calculated at 100% hydrogen peroxide, the pH being 11.0. After each stage, the pulp was washed in accordance with Example 1. The results after the second hydrogen peroxide stage appear from the Table below.

TABLE IV

| Test | Pulp properties after the $H_2O_2$ bleaching | | |
|---|---|---|---|
| | Kappa number | Viscosity ($dm^3$/ka) | Brightness (% ISO) |
| 1 | 0.4 | 750 | 90.3 |
| 2 | 0.9 | 800 | 86.9 |

It is evident from the Table that treatment of pulp according to the present invention, followed by bleaching with ozone and hydrogen peroxide, allows completely chlorine-free bleaching to above 90% ISO as well as removal of practically all lignin in the pulp while maintaining sufficient pulp strength.

EXAMPLE 5

Oxygen-delignified sulphate pulp of softwood having a kappa number of 16, a brightness of 37.1% ISO and a viscosity of 1010 $dm^3$/kg, was treated in accordance with the invention with tow kinds of equilibrium peracetic acid and with a varying amount of peracetic acid (PAA), in order to illustrate the effect of hydrogen peroxide in the peracetic acid used. The conditions in the delignification with peracetic acid, treatment with EDTA as well as the bleaching with hydrogen peroxide were as in Example 2. In one of the equilibrium peracetic acids (PAA-1), the weight ratio between peracetic acid and hydrogen peroxide was 2.1:1. In the other equilibrium peracetic acid (PAA-2), the weigh ratio between peracetic acid and hydrogen peroxide was 9.1:1. The same amount of peracetic acid was added when using both kinds of peracetic acid, irrespective of the content of hydrogen peroxide. After each stage, the pulp was washed in accordance with Example 1. The viscosity after delignification with peracetic acid was 990–1000 $dm^3$/kg in all tests. The viscosity after bleaching with hydrogen peroxide was 900–920 $dm^3$/ kg in all tests. The results after delignification with peracetic acid and bleaching with hydrogen peroxide, appear from the Table below.

TABLE V

| Test No. | Amount of PAA (kg/tonne) | Kind of acid | Brightness after PAA (% ISO) | Brightness after $H_2O_2$ (% ISO) |
|---|---|---|---|---|
| 1 | 3.4 | PAA-1 | 45.1 | 77.9 |
| 2 | 3.4 | PAA-2 | 44.0 | 77.0 |

TABLE V-continued

| Test No. | Amount of PAA (kg/tonne) | Kind of acid | Brightness after PAA (% ISO) | Brightness after $H_2O_2$ (% ISO) |
|---|---|---|---|---|
| 3 | 11.2 | PAA-1 | 49.9 | 79.8 |
| 4 | 11.2 | PAA-2 | 48.3 | 77.9 |
| 5 | 22.4 | PAA-1 | 54.9 | 81.5 |
| 6 | 22.4 | PAA-2 | 52.7 | 79.6 |

It is evident from the Table that treatment of pulp in accordance with the present invention with an equilibrium peracetic acid with a higher content of hydrogen peroxide (PAA-1), has a more positive effect on the brightness after the treatment with peracetic acid as well as the bleaching with hydrogen peroxide, while at the same time the difference in viscosity is very limited.

We claim:

1. A process for delignifying and bleaching oxygen delignified lignocellulose-containing pulp which comprises delignifying said pulp with an organic peracid or salts thereof, thereafter treating the pulp with a complexing agent, washing the pulp after complexing agent treatment, and subsequently bleaching said pulp with a chlorine-free peroxide-containing bleaching agent.

2. The process of claim 1 wherein the oxygen-delignified lignocellulose-containing pulp is a chemically digested pulp.

3. The process of claim 1 wherein the peracid is distilled equilibrium peracetic acid.

4. The process of claim 3 wherein the delignification with peracetic acid is carried out at a pH in the range of from 3 up to 10.

5. The process of claim 4 wherein the delignification with peracetic acid is carried out at a pH in the range of from 5 up to 7.5.

6. The process of claim 1 wherein the peroxide-containing compound consists of hydrogen peroxide or a mixture of hydrogen peroxide and oxygen.

7. The process of claim 1 wherein the pulp is washed after the treatment with a complexing agent at a pH of at least about 4.

8. The process of claim 1 wherein the complexing agent is a nitrogenous organic compound.

9. The process of claim 8 wherein the nitrogenous organic compound is diethylenetriaminepentaacetic acid (DTPA), ethylenediaminetetraacetic acid (EDTA) or mixtures thereof.

10. The process of claim 1 wherein the treatment with a complexing agent is carried out at a pH in the range of from about 2.5 up to about 11.

* * * * *